US005768696A

United States Patent [19]

Law

[11] Patent Number: 5,768,696

[45] Date of Patent: Jun. 16, 1998

[54] WIRELESS 900 MHZ MONITOR SYSTEM

[75] Inventor: Wilson Law, Kowloon, Hong Kong

[73] Assignee: Golden Eagle Electronics Manufactory Ltd., Tsuen Wan, Hong Kong

[21] Appl. No.: 574,199

[22] Filed: Dec. 18, 1995

[51] Int. Cl.[6] ..... H01Q 11/12

[52] U.S. Cl. ..... 455/127; 455/66; 455/128

[58] Field of Search ..... 455/42, 69, 89, 455/90, 127, 128, 126, 314, 88, 67.1, 67.7, 212, 218, 66; 340/539, 573

[56] References Cited

U.S. PATENT DOCUMENTS

| | | | |
|---|---|---|---|
| 4,675,656 | 6/1987 | Narcisse | 340/539 |
| 4,829,570 | 5/1989 | Schotz | 381/3 |
| 4,847,903 | 7/1989 | Schotz | 381/3 |
| 5,119,072 | 6/1992 | Hemingway | 340/573 |
| 5,272,525 | 12/1993 | Borchardt et al. | 358/83 |
| 5,349,386 | 9/1994 | Borchardt et al. | 348/485 |
| 5,373,548 | 12/1994 | McCarthy | 379/63 |
| 5,410,735 | 4/1995 | Borchardt et al. | 455/42 |
| 5,416,802 | 5/1995 | Ishii | 375/316 |
| 5,491,839 | 2/1996 | Schotz | 455/66 |

*Primary Examiner*—Nguyen Vo
*Assistant Examiner*—Darnell R. Armstrong
*Attorney, Agent, or Firm*—Cohen, Pontani, Lieberman, Pavane

[57] ABSTRACT

A communication device for monitoring audio signals transmitted st high frequencies from a remote location. The device includes a transmitter unit and a receiver unit containing a transmitter circuit and a receiver circuit, respectively. The transmitter and receiver circuits are designed for DC operation at voltages substantially equal to the DC voltages directly applied to the transmitter and receiver units so that the use of step-up converters can be avoided, thereby increasing the duration of time for DC power operation.

25 Claims, 8 Drawing Sheets

WIRELESS 900 MHZ MONITOR SYSTEM

BACKGROUND OF THE INVENTION

1. Field of the Invention

This invention broadly relates to a communication system having a receiver unit and a transmitter unit for transmitting and receiving RF signals at frequencies above 900 MHz. More particularly, the present invention pertains to a baby monitor system for transmitting and receiving information at frequencies above 900 MHz and capable of operation at relatively low DC power. Most particularly, the present invention pertains to a battery-powered one-way transmission baby monitor system for transmitting and receiving FM signals above 900 MHz wherein the DC voltages required for operating the receiver circuit and the transmitter circuit are substantially equal to the DC voltages of the batteries powering the receiver unit and the transmitter unit, respectively.

2. Discussion of Background Art

A variety of baby monitor systems are commercially available for monitoring audio and, in some cases, video activity in a vicinity proximate a transmitter unit from a remote location proximate a receiver unit. The transmitter unit typically remains stationary in a subject's room, such as a baby's or child's room, or at other locations in the vicinity of a subject, whereas the receiver unit is typically portable and, therefore, preferably capable of DC battery power operation. Such receiver units allow for easy relocation as the child's guardian moves from one location to another.

Receiver units of presently available baby monitors typically contain a receiver circuit which may be optionally powered by AC, such as from a conventional electronic outlet in conjunction with a voltage rectifier, or via DC, such as from battery cells. The receiver units contain antennas for receiving transmitted FM radio frequency signals and speakers for converting the received RF signals to audio signals. Transmitter units of such heretofore known baby monitors contain transmitter circuits which are also capable of AC or DC operation. Such transmitter units contain a transducer for converting an audio signal—such as a baby's cry—to an electrical signal which is processed by the transmitter circuit and transmitted to the receiver unit via a transmitter antenna. Common features of known baby monitors include a volume control for the receiver speaker as well as a visual indicator, such as an LED on the receiver, to provide visual indication that an audio signal has been received by the receiver unit.

Under prior FCC regulations, present commercial baby monitors operate in either the 27MHz range or the 49 MHz range. However, due to recent FCC regulation changes, consumer electronic devices, including baby monitors, can now be made to operate in the 900 MHz band (i.e. between 902 and 928 MHz). Baby monitors transmitting within the 900 MHz range are desirable because at higher carrier frequencies, the bandwidth for the transmitted audio signal occupies a smaller region of the transmission bandwidth than at lower carrier frequencies. Thus, more channels are available for use at higher carrier frequencies than at lower carrier frequencies, resulting in decreased RF interference and noise in the 900 MHz bandwidth range as well as greater flexibility in channel selection.

An important design criteria for baby monitors is low power consumption and long battery cell life during DC operation. For example, it is desirable for baby monitor receiver and transmitter units to have DC operation utilizing a minimal amount of small battery cells (such as two 1.5 volt batteries) while providing for relatively long battery cell life so that batteries need not often be replaced. The present commercially available baby monitors utilize circuitry in the receiver and/or transmitter units which require and are powered by 9 volts DC. However, for economic reasons, the batteries utilized for DC operation are as low as 3 volts—2 AA batteries for the transmitter and/or receiver units. Thus, to generate the 9 volts needed for receiver and transmitter circuit operation, a DC step-up converter must be employed by the receiver unit to increase the 3 volt DC battery voltage to the 9 volts required for circuit operation.

The use of DC step-up converters, however, results in increased consumption of power due to the power utilized by such converters, thereby resulting in decreased battery life and, therefore, shorter DC operation.

OBJECTS OF THE INVENTION

It is one object of the present invention to overcome problems of prior art baby monitor systems by providing for long lasting DC operation.

A further object of the present invention is to provide a baby monitor capable of receiving and transmitting signals above 900 MHz.

It is still a further object of the present invention to provide a baby monitor capable of receiving and transmitting signals above 900 MHz while providing for operation of the receiver circuit and the transmitter circuit by voltages substantially equal to the DC voltages of the batteries powering the receiver unit and the transmitter unit, respectively, thereby avoiding the use of step-up converters.

Further objects and advantages of the invention will become apparent upon reading the following detailed description of the presently preferred embodiment.

SUMMARY OF THE INVENTION

The present invention is generally directed to a one-way communication device, such as a baby monitor, for monitoring audio signals transmitted at high frequencies from a remote location. The device includes a transmitter unit and a receiver unit containing a transmitter circuit and a receiver circuit, respectively. The transmitter and receiver circuits are designed for DC operation at voltages substantially equal to the DC voltages directly applied to the transmitter and receiver units so that the use of step-up converters can be avoided, thereby increasing the duration of time for DC power operation.

Specifically, the baby monitor device includes a transmitter unit and a receiver unit. The transmitter unit has a housing defining a transmitter cavity therein containing a pair of terminals directly connected to a power source having a first predetermined voltage for supplying the first predetermined voltage to the transmitter cavity, a transducer mounted to the housing for converting the audio signal to an electric signal, a transmitter circuit contained in the transmitter cavity, and a transmitter antenna. The transmitter circuit has an amplifier component connected to the transducer for amplifying the electric signal, and a frequency modulator component having a carrier frequency within the range of 900 to 928 MHz. The carrier frequency is modulated by the amplified electric signal for generating a modulated electric signal which is transmitted to the receiver unit by the transmitter antenna. The transmitter circuit is designed so that the circuit components are powered by a voltage substantially equal to the first predetermined voltage, thereby draining less battery power during DC operation which results in longer DC operating capability.

The receiver unit of the invention includes a housing defining a receiver cavity therein containing a pair of terminals connected to a power source having a second predetermined voltage for supplying the second predetermined voltage to the cavity, a receiver antenna mounted to the housing for receiving the radiated modulated electric signal, a receiver circuit contained in the receiver cavity, and a receiver antenna. The receiver circuit contains a downconverter stage connected to the receiver antenna for converting the modulated electric signal to a second modulated signal having a frequency less than the carrier frequency. The second modulated signal contains frequency components representative of the electric signal generated by the transducer. The receiver circuit also contains a demodulator connected to the downconverter stage for demodulating the second modulated signal to obtain the electric signal which is converted back to the audio signal via a speaker. The receiver circuit is specifically designed so that the downconverter stage and the demodulator are powered by a voltage substantially equal to the second predetermined voltage. Like the transmitter circuit, this feature also provides for less battery drain during DC operation, thereby yielding extended DC operation.

In the preferred embodiment, a phase lock loop section is incorporated into the transmitter circuit for increased transmitter frequency stability and a second downconverter stage is incorporated into the receiver circuit.

Other objects of the present invention will become apparent from the following detailed description considered with the accompanying drawings. It is to be understood, however, that the drawings are designed solely for illustration purposes and not as a definition of the limits of the invention, for which reference should be made to the appended claims.

BRIEF DESCRIPTION OF THE DRAWINGS

In the drawings, wherein like reference numerals designate like elements throughout the various views:

FIGS. 5–8 depict a receiver unit in accordance with a preferred embodiment of the present invention;

DETAILED DESCRIPTION OF THE PRESENTLY PREFERRED EMBODIMENTS

Figure 1:
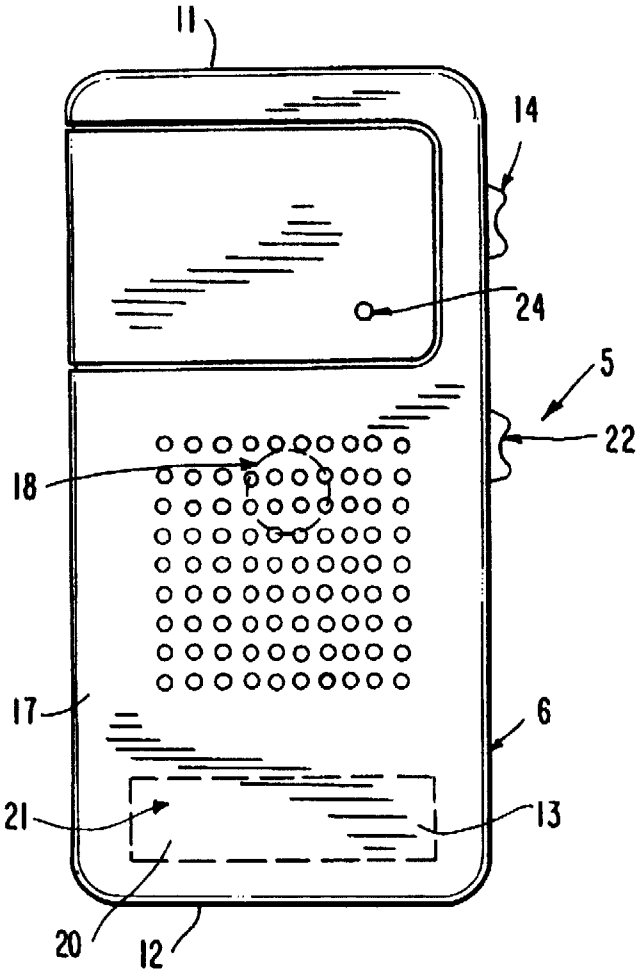
FIGS. 1–5 depict a transmitter unit in accordance with a preferred embodiment of the present invention.
Figure 2:
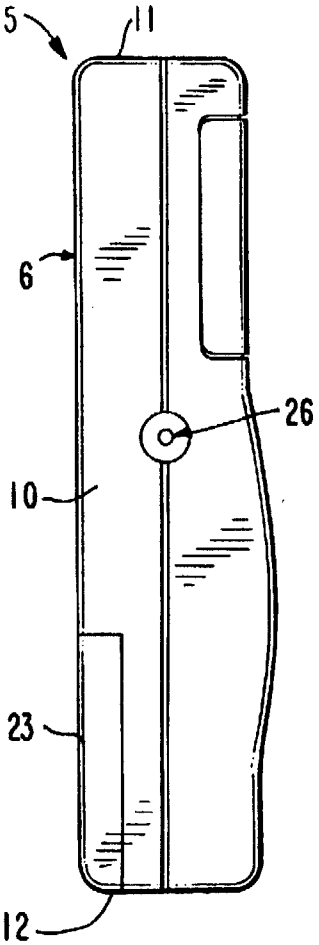
Figure 3:
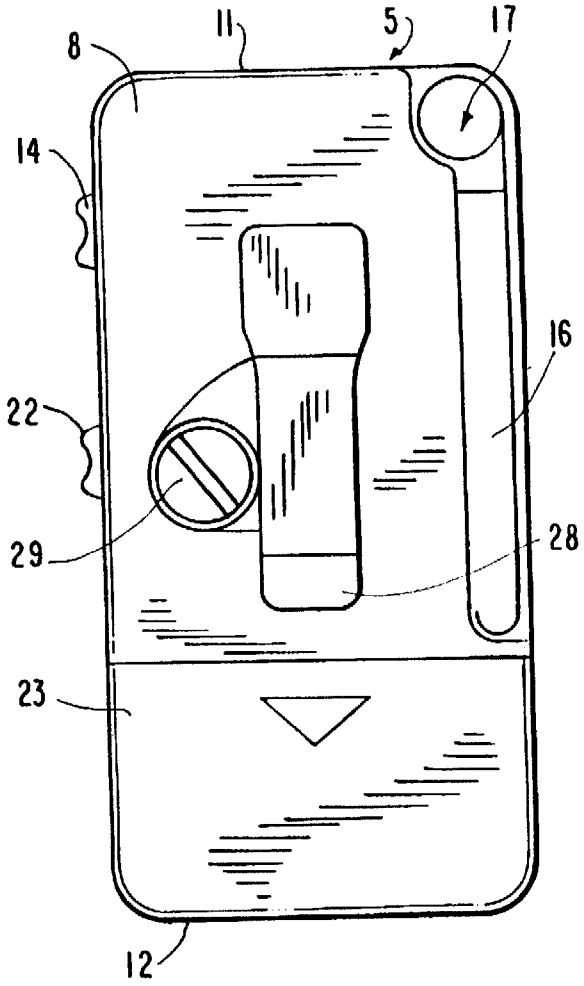
Figure 4:
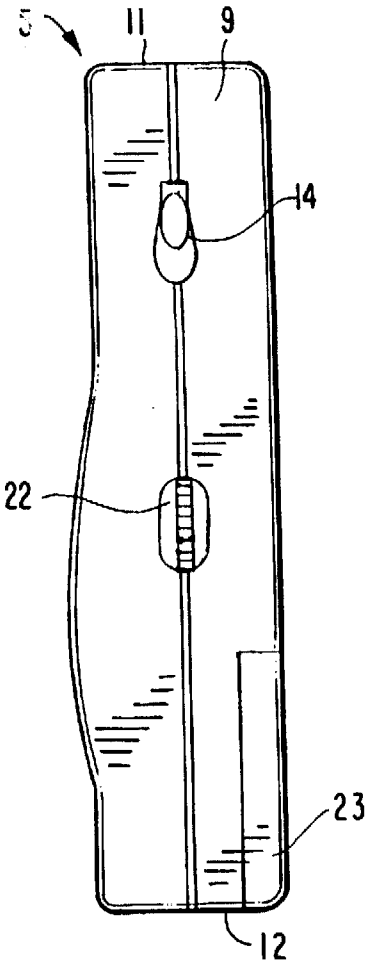
Figure 5:
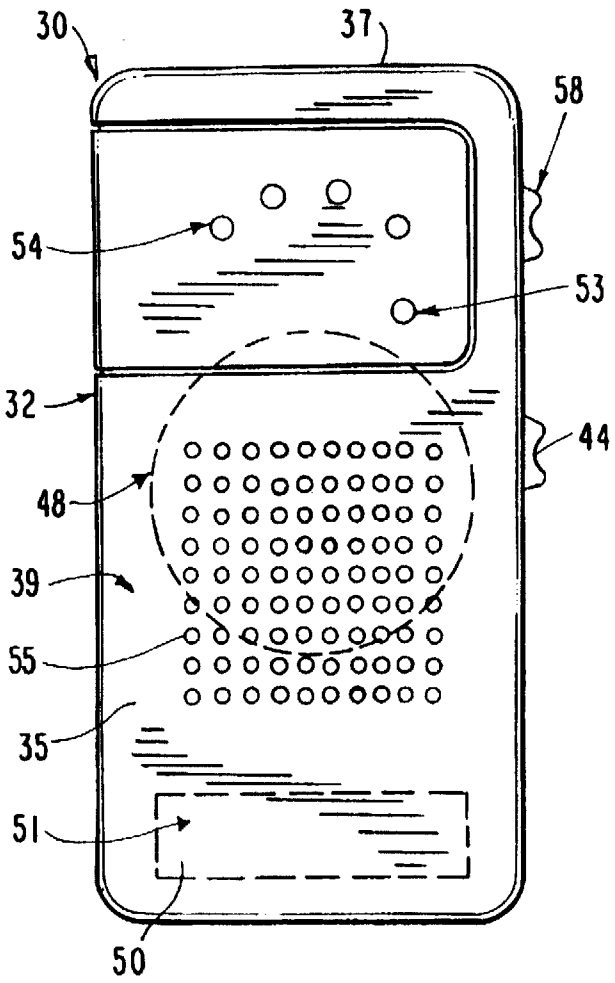
Figure 6:
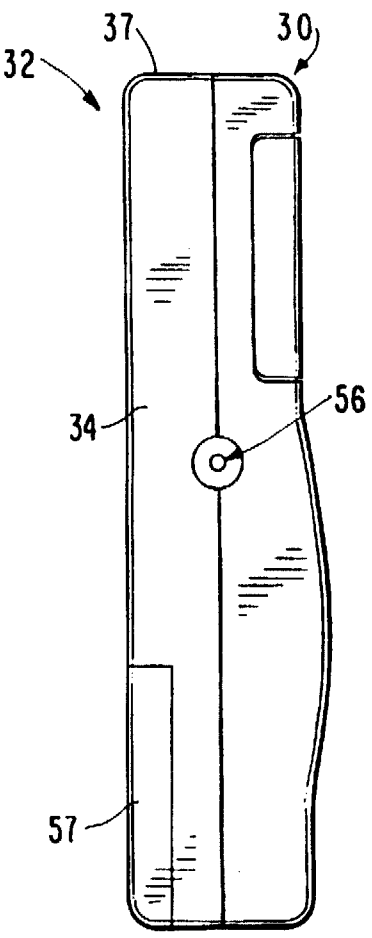
Figure 7:
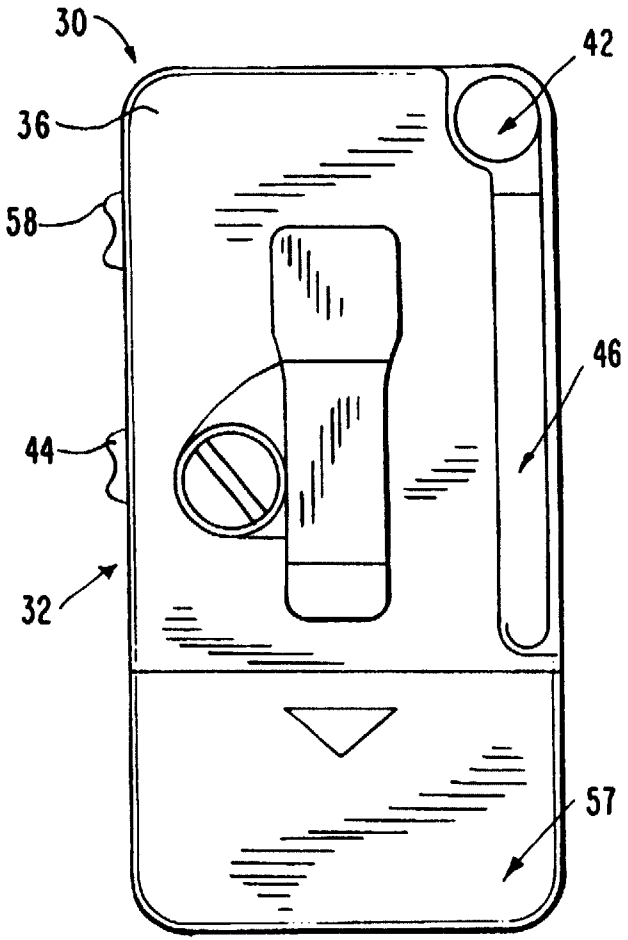
Figure 8:
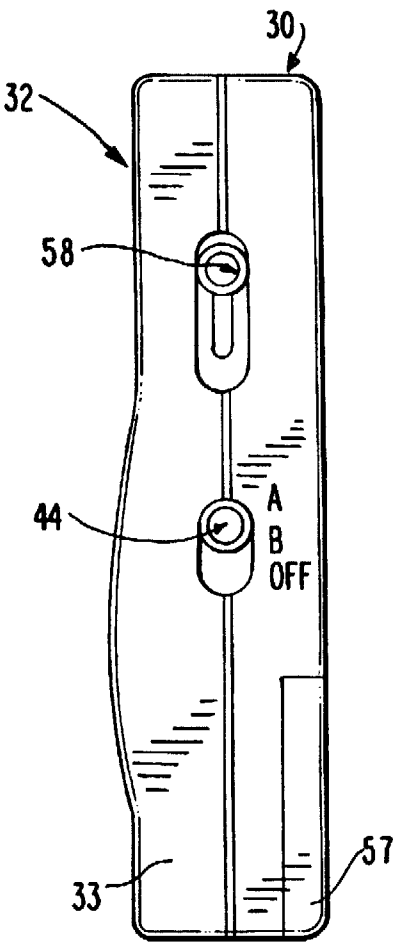

Referring now to the drawings and initially to FIGS. 1–4, a transmitter unit 5 in accordance with the present invention is there depicted. As shown, the transmitter unit includes a housing 6 having a front face 7, a back face 8, a right side 9, a left side 10, a top 11 and a bottom 12 for defining an interior cavity 13 therein. The transmitter unit 5 includes a power switch 14 mounted on housing side 9 and a transmitter antenna 16 pivotally mounted to back face 8 by a pin 17. The transmitter unit also includes a transducer 18, such as a microphone, for receiving an audio signal and converting the received audio signal to an electric signal. The electric signal is input to a transmitter circuit 21 contained on a transmitter circuit board 20 located in the cavity 13 and is used to frequency modulate a high carrier frequency in the 900 MHz band. In the preferred embodiment, a test signal is periodically generated by the transmitter circuit 21 and is transmitted, along with the modulated signal, by the transmitter antenna 16 to a receiver unit, as more fully described below.

Transmitter unit 5 further includes a channel selection switch 22, also mounted in housing side 9, for selecting one of a plurality of transmitter channels within the 900 MHz bandwidth, and an on/off indicator light 24 for indicating when the transmitter unit 5 is "on". As shown, back face 8 contains a transport clip 28 for providing releasable securement of the transmitter unit 5 to various articles, and also contains a thumb screw 29 which provides access to the interior cavity 13 for repairs, etc. The transmitter unit 5 is capable of AC and DC power operation and thus, the back face 8 contains a slidable panel 23 which covers a chamber (not shown) which houses one or more battery cells. In addition, housing 6 also contains an AC input power jack 26 shown mounted to left side 10 for accommodating use of an AC power adapter. In the preferred embodiment, the dimensions of the transmitter housing are relatively small and preferably 100×62×26 millimeters, thereby providing for easy transport and relocation.

FIGS. 5–8 depict a receiver unit 30 in accordance with the present invention. The receiver unit 30 contains a housing 32 which, like transmitter housing 6, contains a right side 33, a left side 34, a front face 35, a back face 36, a top panel 37 and a bottom panel 38 for defining a cavity 39 which contains individual receiver components, as more fully set forth below. The receiver unit 40 includes a power switch 44 mounted on the right side panel 33 for providing power to the receiver unit 30. A receiver antenna 46 pivotally mounted to back face 35 by a pin 42 is provided for receiving the FM radio frequency signal transmitted by the transmitting antenna 16. The received radio frequency signal is, in turn, processed by a receiver circuit 51 contained on a receiver circuit board 50 positioned in the receiver housing cavity 39 and which provides the processed signal to a speaker 48 which converts the processed signal back into the audio signal. Speaker 48 is preferably mounted behind an array of apertures 55 positioned and defined in the front face 45 for providing audio signal dispersion. However, speaker 48 may, alternatively, be mounted behind a similar array of apertures defined in the back panel 36 of the receiver housing 32.

Like transmitter 5, receiver unit 30 includes a channel select switch which is preferably combined with power switch 44, as more fully described below, for selecting between one of a plurality of transmission channels in the 900 MHz frequency band. For example, if receiver unit 5 is transmitting at a first channel, i.e. channel A, whereby channel select switch 22 is in a position for broadcasting at channel A, channel select/power switch 44 must, likewise, be positioned in a designated position for reception of RF signals transmitted at channel A. The inclusion of a channel select mechanism such as channel select switches 22 and 44 is beneficial in signal noise reduction, an important design consideration in baby monitors, because it allows the user to select between one of a plurality of available channels which yields reception of the cleanest signal, i.e. the signal having the least amount of noise.

Receiver unit 30 further includes a power indicator light 53, such as an LED, for indicating that the receiver switch is in the "on"position, a volume adjustment switch 58 and a plurality of indicator lights 54 for signalling to a viewer that the receiver unit 30 is receiving a signal and for indicating the strength of the signal. For example, if the volume switch 58 is set on a low setting, someone viewing the receiver unit 30 can still detect audio activity in the vicinity of the transmitter unit 5 by viewing the indicator lights 54 which will be illuminated when receiver unit 30 receives a transmitted signal.

In the preferred embodiment, the indicator lights 54 are configured to indicate the strength of the transmitter signal by illuminating more lights for a strong signal. For example, if transmitter unit 5 is used for monitoring audio signals emitted by an infant, the loudness of the infant's cry will be proportional to the number of lights 54 that illuminate. Thus, if the volume switch 58 is at a low setting, a guardian viewing the receiver unit 30 can determine the urgency of the infant's cry. Also in the preferred embodiment, one of the indicator lights 54 serves as an out-of-range indicator which will illuminate in the event the receiver unit 30 is moved to a position beyond a maximum receiving range, i.e. a certain distance away from transmitter unit 5. The distance is based on the strength of the test signal received by the receiver unit 30. For example, if a weak test signal is received, the out-of-range indicator will illuminate to alert the user that the receiver unit will not receive the transmitted modulated signal at this location. In addition to a visual out-of-range indicator, an audio signal or alarm can be generated via speaker 48 in the event the receiver unit 30 is beyond the receiving range of the test signal.

Like transmitter housing 6, the dimensions of the receiver housing 22 are relatively small thus allowing for easy relocation. The receiver housing dimensions are preferably 110×62×26 millimeters.

Receiver unit 40, like transmitter unit 10, is capable of AC and DC operation. DC operation is provided by one or more battery cells (not shown) contained in the receiver housing cavity 39 which are covered and secured by battery cover 57 slidably removable from back face 36 as is known in the art. AC operation is provided by use of an AC adapter (not shown) connected to the receiver unit 30 via input AC power jack 56 contained on left side panel 34. In addition, back face 36 contains a transport clip 59 for facilitating securement of receiver unit 30 to various articles. A thumb screw 55 is also provided to allow access to cavity 39 for maintenance and/or repairs.

Figure 9:
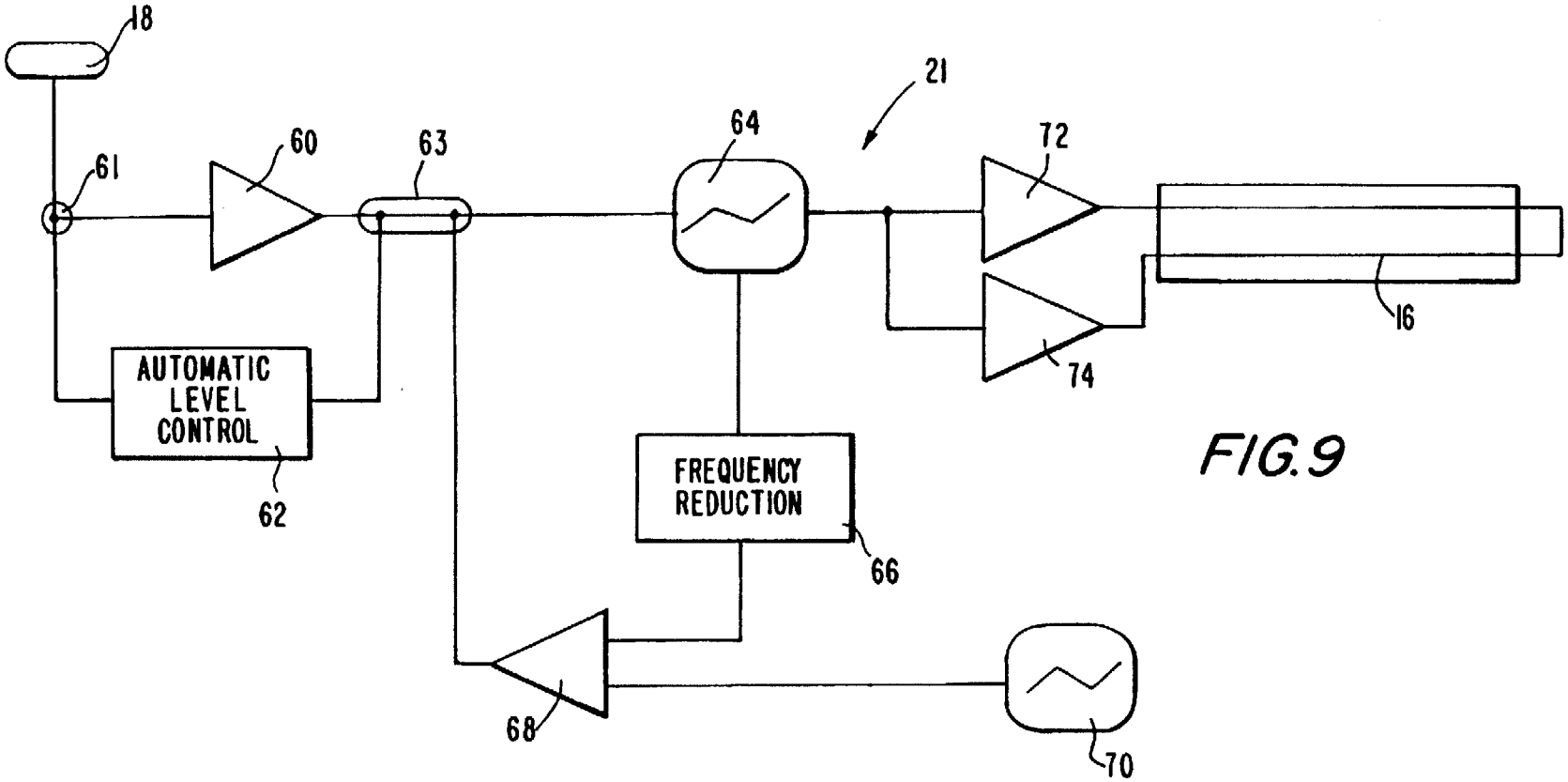
FIG. 9 is a block diagram of the transmitter circuit incorporated in the transmitter unit.

With reference now to FIG. 9, a brief description of the transmitter circuit 21 will now be provided. When an audio signal is received by the transducer or microphone 18, the audio signal is converted to an electric signal, as is known in the art. The electric signal is, in turn, amplified by an audio amplifier 60 and is then used to oscillate a carrier frequency generated by a voltage/current controlled 900 MHz oscillator 64. The carrier frequency is within the range of 902–928 MHz and is frequency modulated by the amplified electric signal. The modulated signal is then amplified by two amplifiers 72 and 74 configured in a push-pull arrangement and operating in opposite phase from each other so that amplifier 72 amplifies the modulated signal directly while amplifier 74 amplifies and provides a phase shift of 180° to the signal. The outputs of amplifiers 72 and 74 are connected to separate conductors of the transmitter antenna 16. In the preferred embodiment, a ¼ wavelength long coaxial cable having an impedance of 50 ohms is used which results in high transmission efficiency at relatively low cost.

The transmitter circuit 51 further includes an automatic level control 62 connected between the output and input terminals of audio amplifier 60 for reducing the level of the input electric signal in the event clipping or distortion of the amplified signal is detected. A phase lock loop feedback branch connected between the 900 MHz oscillator 64 and the output of audio amplifier 60, i.e. at node 63, is also provided to ensure high frequency stability by the current control oscillator 64. The phase lock loop includes a phase comparator 68 which compares a fraction of the modulated electronic signal as generated by the current control oscillator 64 with a reference signal generated by a crystal oscillator 70 having a preset fixed and stable frequency output which is substantially equal to the fraction as generated by a frequency reduction unit 66. In other words, the phase comparator 68 compares the phase of the modulated signal to the phase of a reference signal. If the phase of the modulated signal is equal to the phase of the reference signal generated by the fixed oscillator 70, there will be no output of phase comparator 68. Accordingly, the amplified electric signal generated by audio amplifier 60 will not be adjusted. If, however, a difference in the phase between the signals exists, an error signal will be generated by phase comparator 68 which will be added to or subtracted from the amplified electronic signal at node 63. The use of phase lock loop feedback technology in this manner provides improved frequency stability which would otherwise suffer due to changes in various environmental conditions, such as temperature changes, etc.

Figure 10:
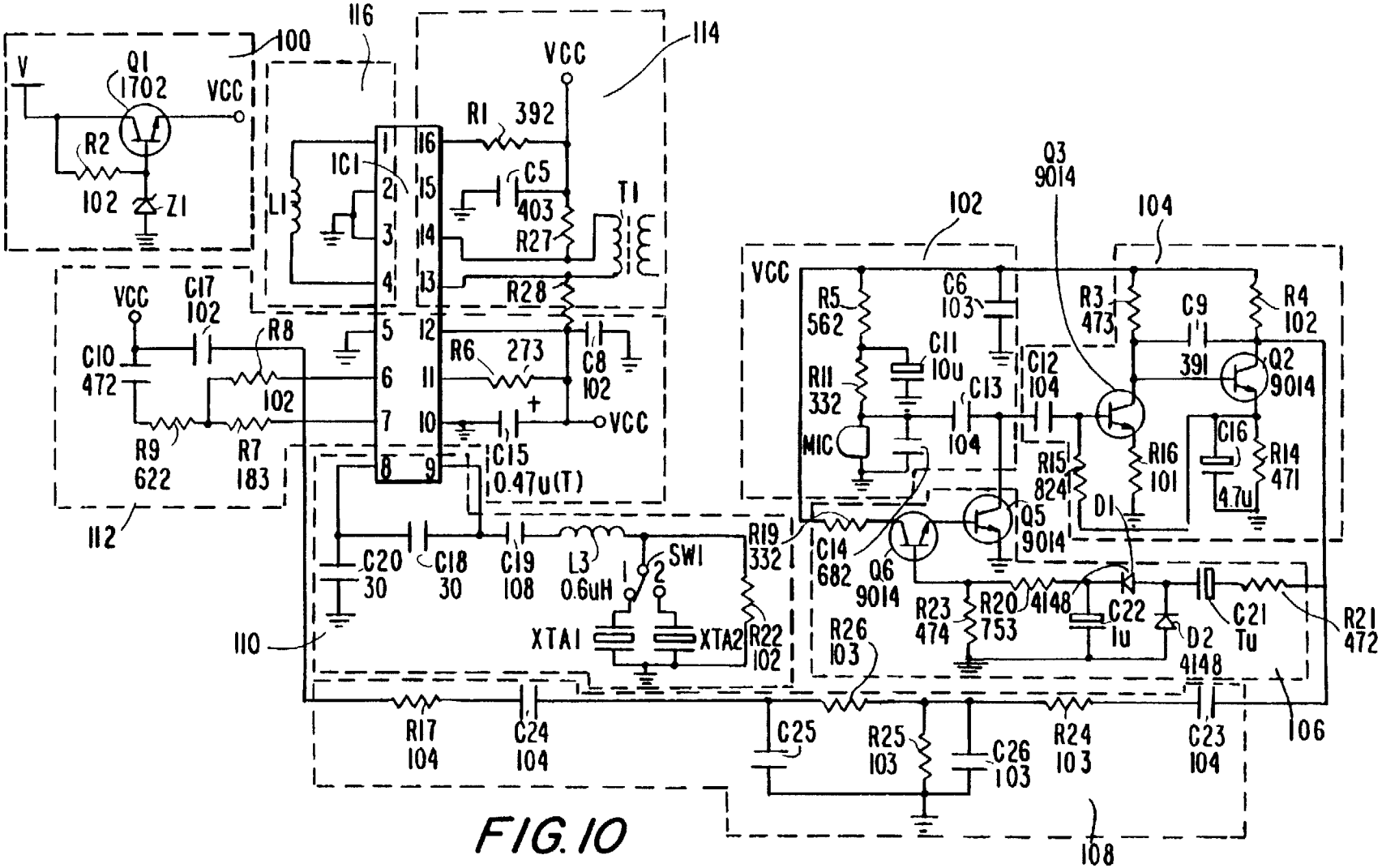
FIG. 10 is a schematic diagram of the transmitter circuit.

Turning now to FIG. 10, a schematic representation of the transmitter circuit 21 in accordance with the preferred embodiment of the present invention is there depicted. The voltage Vcc which is required for operation by the various circuit components is preferably derived during DC operation, directly from battery cells, i.e. Vcc is equivalent to the battery voltage. During AC operation, however, Vcc is equivalent to a rectified AC voltage derived from the use of a suitable AC adaptor connected to input power jack 26. As explained more fully below, the transmitter circuit 21 is designed for very low DC operation in the range of 2.5–3.5 volts. However, for certain applications, it may be necessary or desirable to utilize higher voltage batteries or high voltage AC adaptors. Accordingly, to accommodate these applications, a DC biasing stage 100 may be included for providing the required DC voltage to the various circuit components. The DC biasing stage 100 is powered by a voltage V which is obtained either directly from the battery cells or from a rectified voltage generated by utilizing AC input power jack 26.

As shown, the transmitter circuit 21 further includes a speech processing section 102 connected to microphone 18 and containing resistors $R_5$, $R_{11}$ and capacitors $C_6$, $C_{11}$ and $C_{14}$, which are configured to filter out noise from the electric signal. The filtered electric signal is then amplified by an audio amplifier section 104 (element 60 in FIG. 9) having a cascaded pair of transistors $Q_2$ and $Q_3$. Transistor $Q_2$ is biased by resistors $R_4$, $R_{14}$, $R_{15}$ and capacitors $C_{16}$ whereas transistor $Q_3$ is biased by resistors $R_3$ and $R_{16}$. The collector terminals of both transistors are coupled together via capacitor $C_9$.

The output of audio amplifier section 104 is provided to both an automatic level control section 106 (block 62 in FIG. 9) and to a coupling and filtering section 108. As explained above, the automatic level control section adjusts the level of the incoming electric signal, i.e. the signal applied to the audio amplifier section 114, in the event the signal output from the audio amplifier section is distorted. As shown, level control section 106 contains transistors $Q_5$ and $Q_6$, resistors $R_{19}$, $R_{20}$, $R_{21}$ and $R_{23}$, capacitors $C_{21}$ and $C_{22}$, and diodes $D_1$ and $D_2$. The amplified signal from audio amplifier section 104 is also provided to the coupling and filtering section 108 which further filters the signal and provides it to a phase lock loop section 112 as more fully described below.

The receiver circuit also includes a crystal oscillator section 110 containing two crystal oscillator $XTA_1$ and $XTA_2$ which generate frequencies corresponding to the transmitter channels. The crystal oscillator section 110 provides the first of two signals, i.e. the reference signal, to the phase comparator 68 of the phase lock loop section of the transmitter circuit 21. Crystal oscillator section 110 contains resistor $R_{22}$, inductor $L_3$ and capacitors $C_{18}$, $C_{19}$ and $C_{20}$, as well as a two position switch $SW_1$ selectable between the first oscillating crystal $XTA_1$ and the second oscillating crystal $XTA_2$. The reference signal generated by crystal oscillator section 110 is input to an integrated circuit $IC_1$ which performs the phase lock loop function.

Coupling section 108 provides the amplified electric signal to a frequency reduction and phase comparator section 112 (corresponding to frequency reduction block 66 of FIG. 9) which, in turn, provides the second signal to the phase comparator of the phase lock loop section. The comparison between the first and second signals is performed as an internal function of $IC_1$. Section 112 contains resistors $R_6$, $R_7$, $R_8$, $R_9$, capacitor $C_8$, $C_{10}$, $C_{15}$ and $C_{17}$, as well as $IC_1$.

The remaining sections of the transmitter circuit 21 are an RF differential amplifier and antenna section 114 and a current controlled 900 MHz oscillator 116. Section 116, as explained above, generates a carrier frequency in the 900 MHz band which is modulated by the electric signal. The resulting modulated signal is then provided to amplifier and antenna section 114 (amplifiers 72, 74 of FIG. 9) which amplifies the modulated signal and provides it to antenna 16 for transmission. Section 114 contains transformer $T_1$, resistors $R_1$, $R_{27}$, capacitor $C_5$ and is also connected to $IC_1$.

The component values for the receiver circuit components are indicated in FIG. 10.

Figure 11:
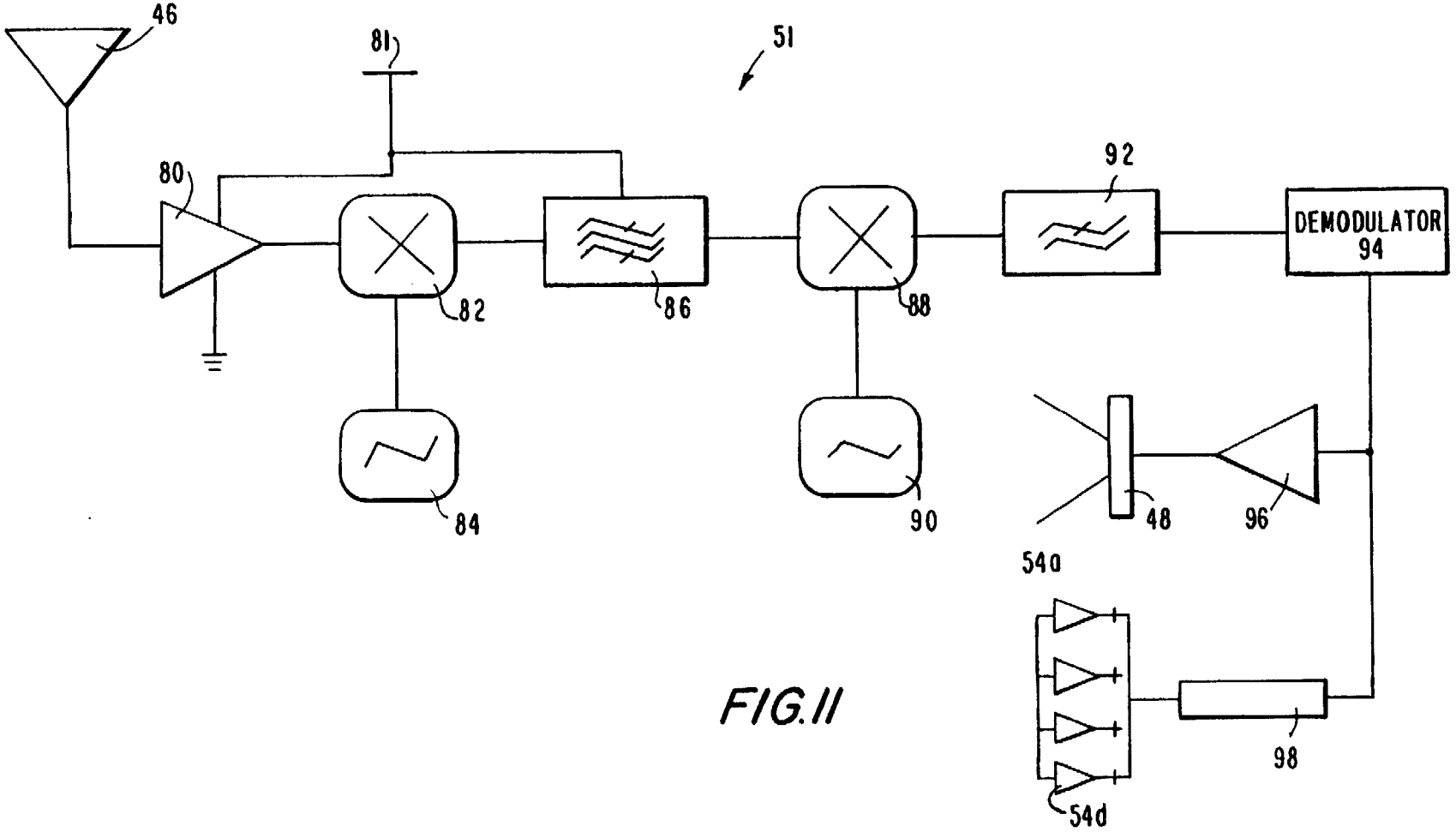
FIG. 11 is a block diagram of the receiver circuit incorporated in the receiver unit.

Turning now to FIG. 11, the receiver circuit 51 is configured as a double conversion superheterodyne receiver having high sensitivity. The receiver circuit 51 is interfaced with the receiver antenna 46, which receives the FM 900 MHz RF signal transmitted by the transmitter unit 5, and provides the received signal to an RF amplifier 80 powered by a DC source 81. As explained above, the DC source can be provided by battery cells or, alternatively, by converting an AC signal input to the receiver unit by a power adapter via AC input power jack 56 located on the receiver housing 32. Also as explained above, the DC source 81 is directly supplied and provided to the receiver circuit 51 without the need of a step-up converter. In other words, the voltage required for receiver circuit operation is substantially equal to the voltage provided by the DC source 81, i.e. the battery cell voltage. In the preferred embodiment, DC source 81 is supplied by two battery cells generating low DC voltage such as 3 volts (i.e. two 1.5 volt AA battery cells). The novel design of the receiver circuit 51 avoids the need for a step-up converter for providing the required power for the individual receiver circuit components. This feature removes the excess drain on the battery cells that a step-up converter creates, thereby increasing the duration of battery operation beyond a 24 hour limit.

The amplified RF signal is output by the RF amplifier 80 and provided to a first downconverter stage of the receiver circuit 51 which consists of a first mixer 82 which partially downconverts the amplified RF signal to a first intermediate frequency by mixing it with a signal generated by a local oscillator 84. In the preferred embodiment, the frequency of the local oscillator is between 824 and 854 MHz and has stable temperature characteristics so that only slight frequency variation occurs as a result of an increase or decrease of temperature of the environment in which the receiver unit 30 is contained. First mixer 82 is cascaded with the output of the RF amplifier 80, thereby resulting in very low current consumption which, in turn, results in a very low level output requirement from the local oscillator 84. Thus, such configuration results in a total current consumption between RF amplifier 80 and mixer 82 of only 4 ma.

As explained above, local oscillator 84 may be operated at fixed frequencies between 824 and 854 MHz. The local oscillator is preferably selected having a frequency variance of only 100 KHz within a temperature range of 0° to 55° C. The resulting partially downconverted signal which is output from first mixer 82 is, in turn, filtered by an active bandpass filter which, in the preferred embodiment, has an intermediate frequency of 81 MHz and a 6 dB bandwidth of approximately 4 MHz. As is known in the art, the oscillator frequency of local oscillator 84 is selected based on the carrier frequency of the transmitted signal to downconvert the signal whereby the transmitted information is centered at the intermediate frequency of the bandpass filter 86, i.e. 81 MHz. For example, if the current control oscillator 64 has a carrier frequency of 911 MHz, the local oscillator frequency will be set at 830 MHz.

With continued reference to FIG. 11, the filtered signal output by bandpass filter 86 is then provided to a second downconverter stage having a second mixer 88 which mixes the filtered signal with a signal generated by a voltage control oscillator (VCO) 90 which further reduces the carrier frequency to a second intermediate frequency. The resulting downconverted signal is provided to a low pass filter 92 which results in a signal having frequency components centered at the second intermediate frequency. In the preferred embodiment, low pass filter 92 has a cut-off frequency at 75 KHz which, as known in the art, is greater than the carrier frequency. The filtered signal is, in turn, provided to a demodulator 94 for demodulation at the second intermediate frequency for recovery of the original modulating electric signal.

The output section of transmitter circuit 51 contains speaker 48 which is driven by an audio amplifier 96 which amplifies the demodulated signal and drives the speaker for broadcasting the transmitted audio signal. In the preferred embodiment, the output section also contains the plurality of light emitting diodes (LEDs) 54*a*-54*d* powered by an LED driver 98 for providing visual monitoring of a subject. For example, and as explained above, in the event volume switch 58 is at a low setting so that the audio signal cannot be audibly detected, the LEDs 54 will illuminate upon detection of an audio signal to alert a guardian that the receiver unit 40 is receiving an audio signal. LEDs 54 are preferably configured for staggered operation. In other words, the number of LEDs illuminated is proportional to the strength of the audio signal received by the receiver unit 30. Thus, for example, if a weak signal is detected, only one LED 54 (i.e. 54*a*) will illuminate, whereas for a strong received signal, more or all of the LEDs will illuminate.

Figure 12:
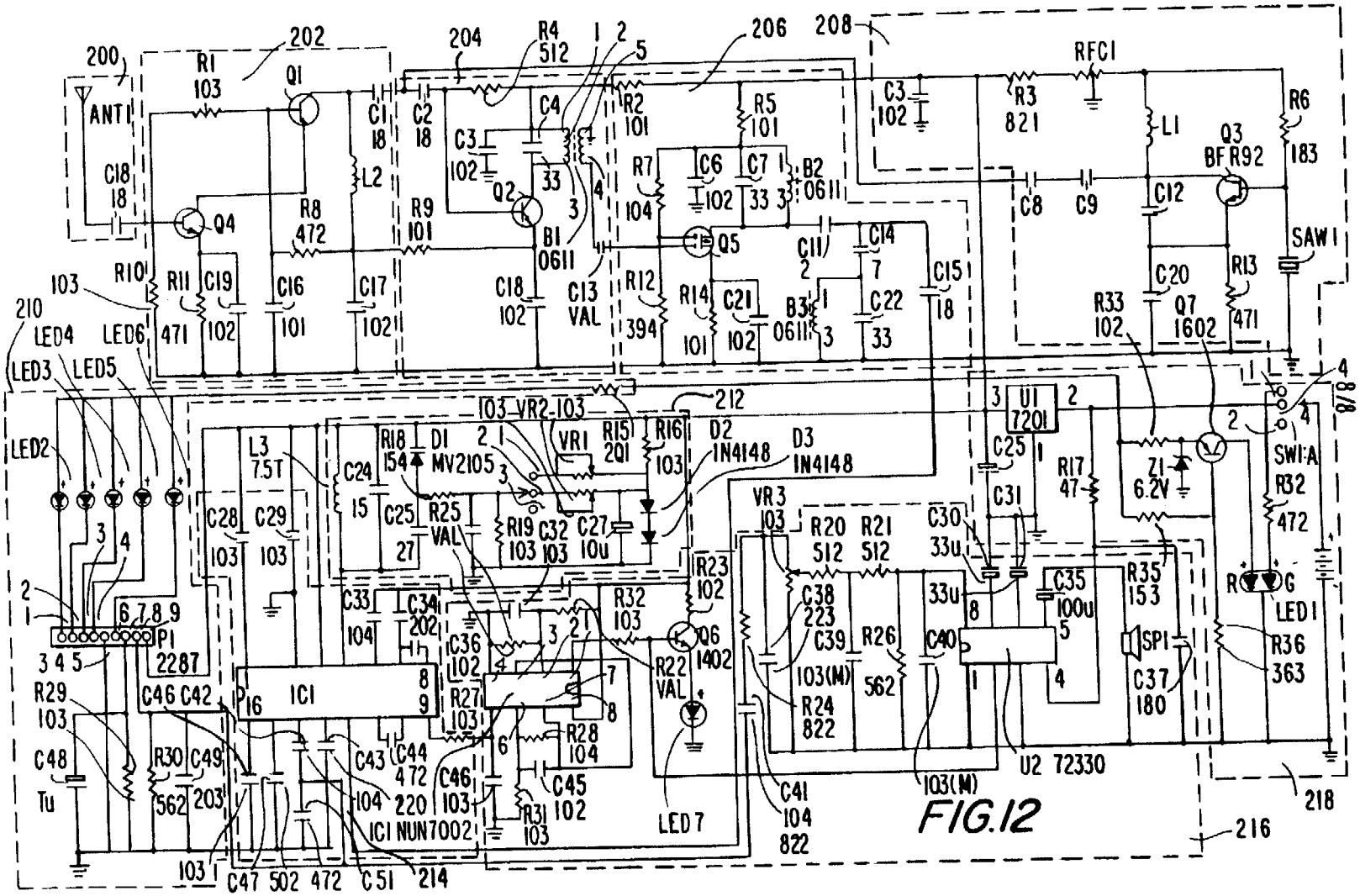
FIG. 12 is a schematic diagram of the receiver circuit.

With reference now to FIG. 12, a schematic representation of the receiver circuit 51 will now be described. As shown, the receiver circuit includes an input stage 200 having the receiver antenna 46 connected to a capacitor $C_{10}$ for providing the transmitted 900 MHz frequency modulated RF signal to an RF amplifier stage 202 (corresponding to RF amplifier 80 in FIG. 11). The RF amplifier stage 202 provides some initial gain and selectivity to the incoming RF signal. Amplifier stage 202 consists of resistors $R_1$, $R_5$, $R_{10}$, $R_{11}$, transistors $Q_1$, $Q_4$, and capacitors $C_1$, $C_{16}$, $C_{17}$ and $C_{19}$.

The amplified RF signal is then provided to a first mixer stage 204 (corresponding to mixer 82 in FIG. 11) which mixes the amplified signal with a local oscillator signal, as is known in the art, for partially downconverting the amplified 900 MHz signal to a lower or first intermediate frequency. The first mixer stage contains transformer $B_1$, transistor $Q_2$, resistors $R_4$ and $R_9$, and capacitors $C_2$, $C_3$, $C_4$, $C_{13}$ and $C_{18}$. The local oscillator signal which is mixed with the amplified RF signal by the first mixer stage 204 is generated by a local oscillator section 208 (corresponding to local oscillator 84 in FIG. 11). The local oscillator stage 208 contains a SAW wave resonator SW, which oscillates at the fixed intermediate frequency between 824 and 854 MHz. As explained above, a preferred characteristic of the SAW resonator is a stable temperature characteristic, i.e. the intermediate frequency will remain constant over a fixed temperature range. The generated SAW wave is amplified and coupled to first mixer stage 204 via transistor $Q_3$, inductor $L_1$ resistors $R_3$, $R_6$, $R_{13}$, and capacitors $C_3$, $C_8$, $C_9$, $C_{12}$ and $C_{20}$. A block or filter $RFC_1$ is also provided for removing RF energy generated by the SAW resonator, thus reducing radiation noise.

The resulting partially downconverted signal is provided to an active bandpass section 206 via capacitor $C_{13}$ from first mixer stage 204 which is connected to the gate terminal of an FET transistor $Q_5$. Active bandpass section 206 corresponds with bandpass filter 86 of FIG. 11 and provides a bandpass having a center frequency of preferably 81 MHz with a 6 dB bandwidth of approximately 4 MHz. Thus, as explained above, the bandpass section 206 filters out the bandpass portion of the amplified mixed electric signal that contains the corresponding transmitted audio information. As shown, bandpass section 206 also contains transformers $B_2$, $B_3$, resistors $R_2$, $R_5$, $R_7$, $R_{12}$, $R_{14}$, and capacitors $C_6$, $C_7$, $C_{11}$, $C_{14}$, $C_{15}$, $C_{21}$ and $C_{22}$.

The output of active bandpass section 206 is provided via capacitor $C_{15}$ to integrated circuit $IC_1$ contained in a low pass filter and demodulator section 214 (corresponding to low pass filter 92 and demodulator 94 in FIG. 11). Integrated circuit $IC_1$ is an FM IF amplifier and demodulator circuit which is interfaced with a voltage control oscillator and mixer section 212 (corresponding to voltage control oscillator 90 and mixer 88 of FIG. 11). The voltage control oscillator section 212 includes a channel select switch $SW_1$:B (corresponding to combined channel select and power switch 58 in FIG. 11) for selecting between one of two available channels and also contains an LC tank circuit consisting of inductor $L_3$ and capacitor $C_{24}$. Channel switching is accomplished by adjusting the potential difference across varactors $VR_1$ and $VR_2$ which are positioned parallel to the LC tank. Other components of voltage control oscillator and mixer section 212 include diodes $D_1$, $D_2$ and $D_3$, resistors $R_{14}$, $R_{18}$, $R_{19}$ and capacitors $C_{24}$, $C_{25}$, $C_{26}$, $C_{27}$.

In a manner well known to those having ordinary skill in the art, section 212 further downconverts the received signal to a carrier frequency less than the intermediate frequency by subtracting the voltage control oscillator signal therefrom. As the active bandpass stage 206 has a preferred center frequency of 81 MHz, the voltage control oscillator signal has a frequency incorporating the center frequency and, preferably, a frequency in the range of 59–87 MHz. The resulting electric signal is provided to $IC_1$ for filtering and demodulation by the low pass filter and demodulation stage 214 (corresponding to filter 92 and demodulator 94 of FIG. 11). The components of low pass filter and demodulator stage 214 includes resistor $R_{27}$ and capacitors $C_{28}$, $C_{29}$, $C_{33}$, $C_{34}$, $C_{36}$, $C_{42}$, $C_{43}$, $C_{44}$, $C_{46}$, $C_{47}$, $C_{51}$ whose values are selected for blocking frequencies above 75 MHz, i.e. a low pass filter providing access for the frequency components containing the desired audio information. The filtered signal is then provided to an amplifier stage for converting the signal to an audio signal via speaker 48 as more fully described below.

With continued reference to FIG. 12, receiver circuit 51 further includes an audio amplifier section 216 (corresponding to audio amplifier 96 in FIG. 11). The audio amplifier section 216 has an audio amplifier $U_2$ and an operational amplifier $IC_2$, both in the form of integrated circuits which are, in turn, interfaced with transistor $Q_6$, resistors $R_{20}$, $R_{21}$, $R_{22}$, $R_{23}$, $R_{24}$, $R_{25}$, $R_{26}$, $R_{31}$, $R_{32}$, varactor $VR_3$, and capacitors $C_{30}$, $C_{31}$, $C_{32}$, $C_{35}$, $C_{38}$, $C_{39}$, $C_{40}$, $C_{45}$, and $C_{50}$. In addition, a light emitting diode $LED_7$ is connected between the emitter terminal of transistor $Q_6$ and ground for indicating when the receiver unit 30 is out-of-range of the transmitter unit 5, as more fully explained above. The audio amplifier and section 216 processes and amplifies the fully downconverted and demodulated signal which is then transformed back to an audio signal via speaker SP, (corresponding to speaker 48 in FIGS. 5 and 11).

As explained above, in addition to speaker 48 for broadcasting audio information, receiver unit 40 also contains a plurality of LEDs 54 for indicating audio activity present at the transmitter unit 10. This feature is depicted in FIG. 12 as LED visual display section 210. As shown, this section contains a plurality of light emitting diodes ($LED_2$–$LED_6$) which, like audio amplifier section 216, receive the demodulated signal from low pass filter and demodulator stage 214. In addition to the light emitting diodes, LED visual display section 210 further includes resistors $R_{15}$, $R_{29}$, $R_{30}$ and capacitors $C_{48}$ and $C_{49}$. As described above, in the preferred embodiment the LEDs are arranged so that all will be illuminated upon receipt of a strong signal by antenna 46 in input stage 200.

The receiver circuit 51 is powered by a power stage 218 which, in turn, is either powered from a DC power supply, such as battery cells, or from DC power derived from an AC adapter connected to receiver unit 30 via AC input power jack 56. For either power situation, the receiver circuit 51 is designed to operate on DC voltage equal to the voltage or the DC equivalent thereof applied to power stage 18. In the preferred embodiment, the voltage required for circuit operation is relatively low, such as 3 volts DC which can be supplied by two 1.5v batteries (i.e. two AA batteries) and the voltage derived therefrom is supplied directly to the receiver circuit via 3 position switch $SW_1$:A. The positions of the switch correspond to first and second channel operation and an "off"state. Also in the preferred embodiment, switch $SW_1$:A is connected to channel select switch $SW_1$:B of VCO stage 212. Thus, to turn the transmitter unit on, switch $SW_1$:A (which corresponds to switch 44 in FIG. 5) will be moved from position 3 to either positions 1 or 2 corresponding to channels A and B, respectively.

The movement of switch $SW_1$:A simultaneously moves switch $SW_1$:B to a corresponding position. For example, if switch $SW_1$:A is moved to position No. 2—corresponding to the receiver circuit receiving signals having a carrier frequency at the channel B frequency—switch $SW_1$:B will, likewise, be adjusted to select channel B reception of signals. It should be readily apparent to those having ordinary skill in the art that a separate channel select switch can be readily substituted for the combined switch 44 described above without deviating from the scope of the present invention.

Power stage 218 further includes transistor $Q_7$, Zenor diode $Z_1$, resistors $R_{17}$, $R_{33}$, $R_{33}$, $R_{34}$, $R_{35}$, $R_{36}$, capacitor $C_{25}$ and an LED pair shown as $LED_1$. The LED pair consists of a red diode and a green diode which serves the dual function of a visual indicator when the receiver unit 30 is "on" as well as an indicator of reception of an RF transmitted signal. For example, when switch $SW_1$:A is in either position 1 or 2, the red LED in $LED_1$ pair will illuminate and, upon reception of an RF signal, green LED in the LED pair will also illuminate.

The preferred component values and part numbers for the receiver circuit components are indicated on FIG. 12.

As is shown in FIGS. 10 and 12, the present invention provides for low voltage DC operation without utilizing step-up voltage converters to obtain the voltage required for receiver and transmitter circuit operation. By designing the receiver and transmitter circuits in this manner, i.e. to avoid the use of a step-up converter, less battery drain results, thereby yielding increased DC operation which, in the preferred embodiment, is in excess of 24 continuous hours.

It will be readily appreciated by those having ordinary skill in the art that the transmitter and receiver circuits can be powered by battery or rectified DC output voltages greater than 3 volts by employing an appropriate voltage converter. For example, if a 9 volt battery is used, a step down converter will be employed to convert the 9 volt battery output voltage to the voltage needed for circuit operation, i.e. 3 volts.

While there have been shown and described and pointed out fundamental novel features of the invention as applied to a currently preferred embodiment thereof, it will be readily understood that various omissions and substitutions and changes in the form and details of the apparatus illustrated, and in its operation, may be made by those skilled in the art without departing from the spirit of the invention. It is expressly intended that all combinations of those elements which perform substantially the same function in substantially the same way to achieve the same results are within the scope of the invention. In addition, various additional features may be included without departing from the scope of the invention. For example, a music chip or other melody generating apparatus may be included in the receiver and/or transmitter units to allow broadcast of a particular melody such as, for example, a lullaby. A motion detector may also be employed in conjunction with microphone 18 on the transmitter unit 5 so that motion of a subject can be detected as well as audio signals emanated by the subject and the motion activity can be indicated to the receiver unit 30 in the form of the LED display. A night light may also be included in either or both of the transmitter and receiver units. Also, it is contemplated that the receiver unit may function as a transmitter and that the transmitter may function as a receiver, so that the monitoring system can also serve as a n intercom. Lastly, it is to be understood that the drawings are not necessarily drawn to scale but that they are merely conceptual in nature. It is the intention, in any event, to be limited only as indicated by the scope of the claims appended hereto.

I claim:

1. A low power communication device for transmitting and receiving frequency modulated radio signals in the 900 MHz band for monitoring an audio signal from a remote location, said device comprising:

a transmitter unit having a housing defining a transmitter cavity therein and a pair of terminals directly connected to a power source having an unregulated predetermined DC output voltage;

a transducer mounted to said housing for converting the audio signal to an electric signal;

a transmitter circuit disposed in said transmitter cavity and connected to said pair of terminals, said circuit including, an amplifier component connected to said transducer for amplifying said electric signal; and a frequency modulator component having a carrier frequency within the range of 900 to 928 MHz, said carrier frequency being modulated by said amplified electric signal for generating a modulated electric signal;

a transmitter antenna connected to said modulator for radiating said modulated electric signal;

a receiver unit having a housing defining a receiver cavity therein;

a receiver antenna mounted to said housing for receiving said radiated modulated electric signal;

a receiver circuit disposed in said receiver cavity, said receiver circuit including, a downconverter stage connected to said receiver antenna for converting said modulated electric signal to a second modulated signal having a frequency less than said carrier frequency, said second modulated signal containing frequency components representative of said electric signal generated by said transducer; and a demodulator connected to said downconverter stage for demodulating said second modulated signal to obtain said electric signal; and a speaker for converting said electric signal to said audio signal;

wherein said components of said transmitter circuit are driven by a voltage substantially equal to said unregulated predetermined DC output voltage so that one of a voltage regulator voltage step-up converter and voltage step-down converter is not required for transmitter circuit operation.

2. The device of claim 1, wherein said transmitter circuit further comprises a phase lock loop connected between the output and input of said frequency modulator component for comparing a portion of said modulated electric signal with a reference signal for providing frequency adjustment of the modulated electric signal.

3. The device of claim 1, wherein said transmitter circuit further comprises means for reducing the amplitude of said electric signal if said amplitude exceeds a threshold value.

4. The device of claim 2, wherein said transmitter circuit further comprises means for reducing the amplitude of said electric signal if said amplitude exceeds a threshold value.

5. The device of claim 4, further comprising a second downconverter stage connected between said first downconverter stage and said demodulator for reducing the intermediate frequency of said second modulated signal to a second intermediate frequency.

6. The device of claim 5, wherein said receiver housing has a second pair of terminals directly connected to a power source having a second predetermined DC output voltage and wherein said first and second downconverters and said demodulator are powered by a voltage substantially equal to said second predetermined voltage.

7. The device of claim 6, wherein said receiver circuit further comprises visual indicator means for indicating detection of said received modulated signal by said receiver antenna.

8. The device of claim 1, wherein said transmitter unit transmits a test signal having a predetermined strength and wherein said receiver unit further comprises an indicator alarm for determining if the strength of the received test signal is below the predetermined strength, thereby indicating that the receiver unit is out-of-range of the transmitter unit.

9. The device of claim 7, wherein said first predetermined voltage is less than 3.5 volts and wherein said second predetermined voltage is less than 3.5 volts.

10. A low power communication device for transmitting and receiving frequency modulated radio signals in the 900 MHz band for monitoring an audio signal from a remote location, said device comprising:

a transmitter unit having a housing defining a transmitter cavity therein;

a transducer mounted to said housing for converting the audio signal to an electric signal;

a transmitter circuit disposed in said transmitter cavity, said circuit including, an amplifier component connected to said transducer for amplifying said electric signal; and a frequency modulator component having a carrier frequency within the range of 900 to 928 MHz, said carrier frequency being modulated by said amplified electric signal for generating a modulated electric signal;

a transmitter antenna connected to said modulator for radiating said modulated electric signal;

a receiver unit having a housing defining a receiver cavity therein and a pair of terminals directly connected to a power source having a predetermined unregulated DC output voltage;

a receiver antenna mounted to said housing for receiving said radiated modulated electric signal;

a receiver circuit disposed in said receiver cavity and connected to said pair of terminals, said receiver circuit including, a downconverter stage connected to said receiver antenna for converting said modulated electric signal to a second modulated signal having a frequency less than said carrier frequency, said second modulated signal containing frequency components representative of said electric signal generated by said transducer; and a demodulator connected to said downconverter stage for demodulating said second modulated signal to obtain said electric signal; and a speaker for converting said electric signal to said audio signal;

wherein said downconverter stage and said demodulator of said receiver circuit are driven by a voltage substantially equal to said unregulated predetermined DC output voltage so that one of a voltage regulator, voltage step-up converter and voltage step-down converter is not required for receiver circuit operation.

11. The device of claim 10, wherein said transmitter circuit further comprises a phase lock loop connected between the output and input of said frequency modulator component for comparing a portion of said modulated electric signal with a reference signal for providing frequency adjustment of the modulated electric signal.

12. The device of claim 10, wherein said transmitter circuit further comprises means for reducing the amplitude of said electric signal if said amplitude exceeds a threshold value.

13. The device of claim 12, further comprising a second downconverter stage connected between said first downconverter stage and said demodulator for reducing the intermediate frequency of said second modulated signal to a second intermediate frequency.

14. The device of claim 13, wherein said transmitter housing has a second pair of terminals directly connected to a power source having a second predetermined DC output voltage and wherein said transmitter circuit components are powered by a voltage substantially equal to said second predetermined voltage.

15. The device of claim 14, wherein said receiver circuit further comprises visual indicator means for indicating detection of said received modulated signal by said receiver antenna.

16. The device of claim 10, wherein said transmitter unit transmits a test signal having a predetermined strength and wherein said receiver unit further comprises an indicator alarm for determining if the strength of the received test signal is below the predetermined strength, thereby indicating that the receiver unit is out-of-range of the transmitter unit.

17. The device of claim 15, wherein said first predetermined voltage is less than 3.5 volts and wherein said second predetermined voltage is less than 3.5 volts.

18. A low power communication device for transmitting and receiving frequency modulated radio signals in the 900 MHz band for monitoring an audio signal from a remote location, said device comprising:

a transmitter unit having a housing defining a transmitter cavity therein and a first pair of terminals directly connected to a power source having a first unregulated predetermined DC output voltage;

a transducer mounted to said housing for converting the audio signal to an electric signal;

a transmitter circuit disposed in said transmitter cavity and connected to said first pair of terminals, said circuit including, an amplifier component connected to said transducer for amplifying said electric signal; and a frequency modulator component having a carrier frequency within the range of 900 to 928 MHz, said carrier frequency being modulated by said amplified electric signal for generating a modulated electric signal;

a transmitter antenna connected to said modulator for radiating said modulated electric signal;

wherein said components of said transmitter circuit are powered by a voltage substantially equal to said first unregulated predetermined DC output voltage so that one of a voltage regulator, voltage step-up converter and voltage step-down converter is not required for transmitter circuit operation;

a receiver unit having a housing defining a receiver cavity therein and a second pair of terminals directly connected to a power source having a second unregulated predetermined DC output voltage;

a receiver antenna mounted to said housing for receiving said radiated modulated electric signal;

a receiver circuit disposed in said receiver cavity and connected to said second pair of terminals, said receiver circuit including, a downconverter stage connected to said receiver antenna for converting said modulated electric signal to a second modulated signal having a frequency less than said carrier frequency, said second modulated signal containing frequency components representative of said electric signal generated by said transducer; and a demodulator connected to said downconverter stage for demodulating said second modulated signal to obtain said electric signal; and a speaker for converting said electric signal to said audio signal;

wherein said downconverter stage and said demodulator of said receiver circuit are powered by a voltage substantially equal to said second unregulated predetermined DC output voltage so that one of a voltage regulator, voltage step-up converter and voltage step-down converter is not required for receiver circuit operation.

19. The device of claim 18, wherein said transmitter circuit further comprises a phase lock loop connected between the output and input of said frequency modulator component for comparing a portion of said modulated electric signal with a reference signal for providing frequency adjustment of the modulated electric signal.

20. The device of claim 18, wherein said transmitter circuit further comprises means for reducing the amplitude of said electric signal if said amplitude exceeds a threshold value.

21. The device of claim 19, wherein said transmitter circuit further comprises mean for reducing the amplitude of said electric signal if said amplitude exceeds a threshold value.

22. The device of claim 21, further comprising a second downconverter stage connected between said first downconverter stage and said demodulator for reducing the intermediate frequency of said second modulated signal to a second intermediate frequency.

23. The device of claim 22, wherein said receiver circuit further comprises visual indicator means for indicating detection of said received modulated signal by said receiver antenna.

24. The device of claim 18, wherein said transmitter unit transmits a test signal having a predetermined strength and wherein said receiver unit further comprises an indicator alarm for determining if the strength of the received test signal is below the predetermined strength, thereby indicating that the receiver unit is out-of-range of the transmitter unit.

25. The device of claim 23, wherein said first predetermined voltage is less than 3.5 volts and wherein said second predetermined voltage is less than 3.5 volts.

* * * * *